United States Patent [19]

Young

[11] 3,956,108

[45] May 11, 1976

[54] ANTI-PLUGGING DEVICE FOR AUTOMATIC DEVELOPABILITY CONTROL SYSTEMS

[75] Inventor: Eugene F. Young, Henrietta, N.Y.

[73] Assignee: Xerox Corporation, Stamford, Conn.

[22] Filed: July 30, 1973

[21] Appl. No.: 384,138

[52] U.S. Cl. ..... 209/10; 209/215; 209/223 A; 209/231; 118/603

[51] Int. Cl.[2] ..... B03C 1/30

[58] Field of Search ... 209/212–215, 223 A, 223 R, 209/225–227, 231, 39, 40, 3, 10, 1, 127 R, 209/81, 120 R; 118/603, 610; 222/148; 198/41; 355/3 DD

[56] References Cited

UNITED STATES PATENTS

| | | | |
|---|---|---|---|
| 148,517 | 3/1874 | Smith | 209/225 |
| 396,356 | 1/1889 | Edison | 209/231 |
| 751,638 | 2/1904 | Harrington | 209/215 |
| 1,384,821 | 7/1921 | Blum | 209/120 X |
| 1,425,235 | 8/1922 | Bradley | 209/223 R |
| 1,723,615 | 8/1929 | Manlin | 209/120 X |
| 1,988,324 | 1/1935 | Maxwell | 209/120 |
| 2,703,175 | 3/1955 | Beckino | 209/223 R |
| 3,117,080 | 1/1964 | Krestin | 209/215 X |
| 3,526,338 | 9/1970 | Goodrich | 222/1 |
| 3,610,205 | 10/1971 | Rarey | 118/603 X |
| 3,610,749 | 10/1971 | Madrid | 209/127 X |
| 3,679,009 | 7/1972 | Bullock | 118/7 X |
| 3,698,926 | 10/1972 | Furvichi | 355/3 DD |
| 3,716,946 | 2/1973 | oraf | 209/214 X |
| 3,823,689 | 7/1974 | Dietz | 118/637 |
| 3,828,728 | 8/1974 | Yang | 118/637 |

FOREIGN PATENTS OR APPLICATIONS

| | | | |
|---|---|---|---|
| 2,747 | 2/1899 | United Kingdom | 209/214 |
| 721,514 | 4/1942 | Germany | 209/225 |

*Primary Examiner*—Robert Halper

[57] ABSTRACT

An automatic developability control system is provided in the developer assembly of an electrostatic reproduction apparatus to sample toner particle developability. Upon an indication that replenishment of toner powder is necessitated, the control system is operative to activate a toner powder dispensing apparatus. The developer mixture may be comprised of magnetic toner particles or magnetic carrier particles to which toner powder is adhered. To prevent debris material such as paper scraps, fibers, dust, bits of rubber, etc. from plugging or jamming the toner powder sensing device of the control system, provision is made for separating the developer mixture from debris material prior to the introduction of developer mixture into the control system.

11 Claims, 7 Drawing Figures

ANTI-PLUGGING DEVICE FOR AUTOMATIC DEVELOPABILITY CONTROL SYSTEMS

Background of the Invention

This invention relates to electrostatic or electrographic reproduction apparatus and in particular to a novel anti-plugging device for automatic developability control systems utilized in connection with such apparatus.

In electrostatic reproduction processes, a photoreceptive plate, which may comprise a layer of photoconductive material on a conductive backing, is given a uniform electric charge over its surface and is then exposed to the information to be reproduced by various projection techniques. This exposure discharges the plate in accordance with the light intensity reaching it, thereby creating a latent electrostatic image on the plate. Alternatively, in electrographic reproduction apparatus, a recording stylus, which may take the form of a plurality of rows of closely spaced electrodes, is provided. The selective energization of individual electrodes is effective to provide a latent electrostatic image on a suitable recording medium, which image is defined by the particular electrodes energized.

Development of an electrostatic image is effected by developers which may take the form of single component developers or plural component developer mixtures. Single component development of a latent electrostatic image may be effected by the application of toner powder to a photoreceptive plate by aeration, fur brush, or magnetic brush techniques, or the like; or by the application of a suitable single component liquid developer. In addition, development of a latent electrostatic image may be effected by cascading a two-component developer mixture which may comprise a suitable pigmented or dyed resin-based powder, hereinafter referred to as toner powder, and a granular carrier material which may be magnetic or non-magnetic and which functions to charge the toner powder by triboelectrification and to carry the charged toner powder. More specifically, the function of the carrier material is to provide mechanical control over the toner powder, in for example carrying toner powder to an image surface and simultaneously provide almost complete homogeneity of charge polarity. In the development of latent electrostatic images, the toner powder is brought into surface contact with the photoreceptive plate and is held thereon electrostatically in a pattern corresponding to the latent electrostatic image. Thereafter, the developed image may be transferred to a support material to which it may be fixed by any suitable means such as heat fusing.

In the mixture of toner powder and carrier material, particles of toner powder, which are many times smaller than particles or beads of carrier material, adhere to and coat the surface of carrier material. During development, as the toner-coated carrier material cascades or tumbles over the photoreceptive plate carrying an electrostatic latent image of opposite polarity to the charge on the toner powder, particles of toner powder are pulled away from the carrier material by the forces exerted thereon by the latent electrostatic image and are deposited on the plate to form a developed toner powder image. As the toner powder images are formed, additional toner powder must be supplied to the developer mixture to replenish the toner powder deposited on the photoreceptive plate. The toner powder material may, for example, be of the type disclosed in Carlson U.S. Pat. No. 2,940,934, wherein the toner particles comprise a finely divided pigmented resin having a particle size less than 20 microns and preferably an average particle size between about 5 and 10 microns and form a finely divided uniform mixture of pigment in a non-tacky, low-melting resin. Desirably, the pigment will be a black pigment such as carbon black or other minutely divided carbonaceous pigment.

As the toner powder in the developer mixture is depleted during the development of the latent image on the photoreceptive plate, more toner powder must be added to maintain a desirable level of copy density. In the event that an excessive amount of toner powder is added to the developer mixture, heavy deposits thereof in the image areas in combination with an undesirable deposit of toner powder in the non-image or background areas results in reproductions of poor contrast with blotchy images or poor resolution.

In addition, overtoning adds to the severity of toner powder accumulation on critical machine components such as the illumination system, optical system, corona generating apparatus, fuser and transport system, as well as necessitating more frequent replacement of filter bags and cleaning brushes. Thus, with an automatic developability control system incorporated in an electrostatic reproduction machine to regulate the concentration of toner powder in the developer mixture, less maintenance is required to keep the quality of the electrostatic reproductions at a high level.

Automatic developability control systems of the type disclosed in the W. R. Goodrich et al. U.S. Pat. No. 3,526,338, which is assigned to Xerox Corporation, are effective to regulate the concentration of toner powder in the developer mixture by sampling developer mixture to ascertain whether or not the replenishment of toner powder is necessary, and in the event that the sampling operation indicates the necessity of toner powder replenishment, a suitable dispensing apparatus is operated to supply additional toner powder to an appropriate sump or reservoir in the developer assembly. In a preferred manner of sampling toner powder developability, a portion of the developer mixture is introduced into a passage defined by two transparent electrically conductive plates or electrodes which may be comprised of materials such as tin oxide and are commercially available under the trademark NESA Glass. A suitable electrical potential is selectively supplied to the plates to attract toner powder to the plates although the polarity of this potential may be cyclically reversed to electrically clean the plates and enable an accurate sensing of the deveopability of toner powder continuously introduced into the passage between the transparent plates. A light source and photocell arrangement are preferably disposed exteriorly and on opposite sides of the plates so that the amount of light detected by the photocell is indicative of the concentration of toner powder on the plates and hence the developability of the developer mixture. Accordingly, the electrical output signal of the photocell device is employed as a control signal for the automatic developability control system. Toner powder is preferably removed from the transparent conductive plates by the aforementioned cleaning operation with the released toner powder being returned to the sump or reservoir. Alternatively, the transparent plates may be comprised of non-conductive materials such as common glass. However, non-conductive transparent plates are required to be cleaned mechanically which is not as efficient as the previously mentioned electrical cleaning technique utilizable with conductive transparent plates.

A problem which has become apparent from the prolonged usage of electrostatic reproduction equipment employing automatic developability control systems is that debris material, e.g. paper scraps, fibers, dust, bits of rubber, etc. becomes intermingled with developer materials and, during the sampling operations set forth above, the debris material tends to occlude the normal flow of developer material through the control system. Thus the passage defined by the aforementioned transparent conductive plates is susceptible to being easily plugged or jammed with debris material thereby preventing the aforementioned detection of toner powder developability.

Objects of the Invention

Therefore, it is an object of the present invention to provide improved development apparatus for electrostatic and electrographic reproduction equipment.

Another object of the invention is to provide apparatus for preventing the interruption of operation of an automatic developability control system utilized in connection with such development apparatus.

It is a further object of the present invention to provide apparatus for allowing developer material to flow substantially unimpeded through the sensing device of an automatic developability control system.

Still another object of the present invention is to provide apparatus for preventing debris material, intermingled with developer material, from jamming or occluding the sensing device of an automatic developability control system.

Yet another object of the present invention is to provide apparatus for separating foreign matter from the developer material prior to introduction of the developer material into an automatic developability control system.

Summary of the Invention

These and other objects are attained in accordance with the present invention wherein at least a portion of developer material utilized with the developing apparatus of an electrostatic or electrographic reproduction machine is supplied to an automatic developability control system with the developer material being separated from debris material prior to introduction of developer material into the control system.

Brief Description of the Drawings

The invention will be more clearly understood by reference to the following detailed description of exemplary embodiments thereof in conjunction with the following drawings in which.

Detailed Description of the Invention

Figure 1:
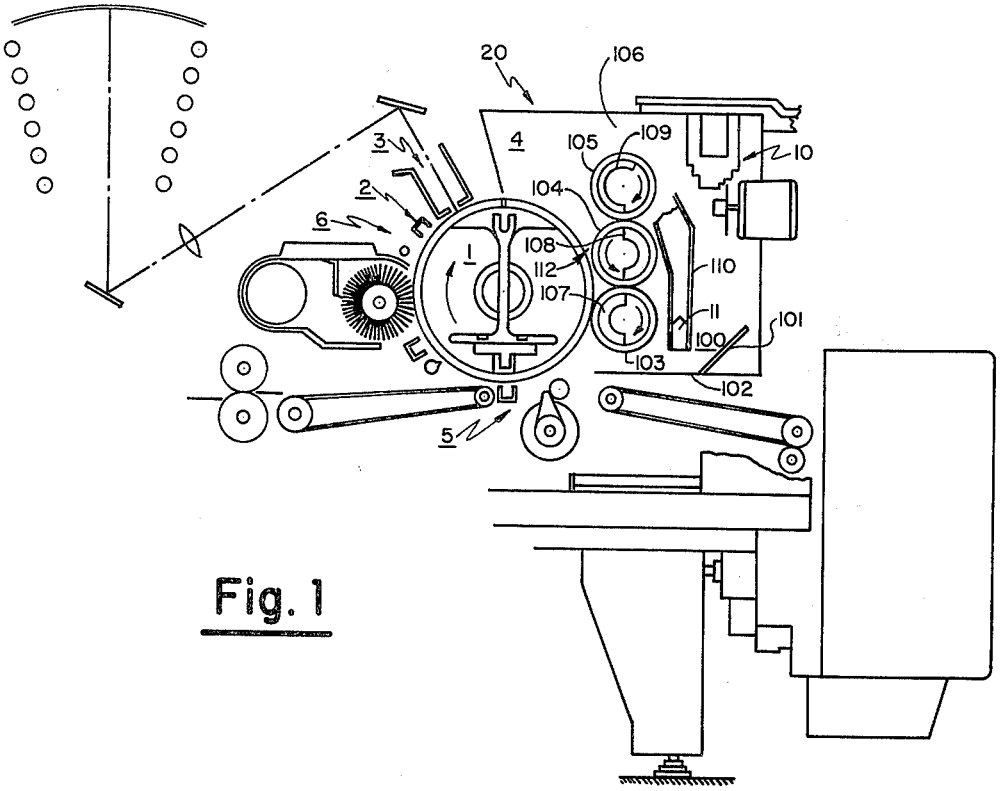
FIG. 1 is a front elevation view of an exemplary embodiment of an automatic electrostatic reproduction machine utilizing the present invention.

Referring now to the drawings, there is shown in FIG. 1 an exemplary embodiment of the present invention in a suitable environment such as an electrostatic reproduction apparatus, although it should be noted that the invention is not intended to be limited thereto.

The illustrated electrostatic reproduction apparatus may comprise a photoreceptor in the form of a plate 1 including a photoconductive layer or light receiving surface on a conductive backing, and may be journaled in a frame to rotate in the direction indicated by the arrow to cause the plate surface to sequentially pass a series of processing stations. The photoreceptor depicted is provided in a drum configuration although it is realized that the photoreceptor may take other forms and may comprise an endless belt entrained about a suitable arrangement of drive and idler pulleys. In addition, the printing apparatus illustrated in FIG. 1 may take the form of an electrographic reproduction machine capable of depositing an electrostatic latent image on an insulating surface by selective energization of stylus means or the like.

For the purpose of the present disclosure, the several electrostatic reproduction processing stations in the path of movement of the photoreceptor surface may be described functionally, as follows:

A charging station 2 at which a uniform electrostatic charge is deposited on the photoconductive plate;

- an exposure station 3 at which a light or radiation pattern of a copy to be reproduced is projected onto the plate surface to dissipate the charge in the exposed areas thereof to thereby form a latent electrostatic image of the copy to be reproduced;
- a developing station 4 at which the developer material, including toner powder having an electrostatic charge opposite to that of the latent electrostatic image is applied to the plate surface, whereby toner powder adheres to the latent electrostatic image to form a toner powder image in the configuration of the copy being produced.
- a transfer station 5 at which the toner powder image is electrostatically transferred from the plate surface to a transfer material or a support surface; and
- a cleaning and discharge station 6 at which the surface of plate 1 is brushed to remove residual toner powder remaining thereon after image transfer, and exposed to a relatively bright light source to effect a substantially complete discharge of any residual electrostatic charge remaining thereon.

The foregoing description of the electrostatic reproduction processing stations will be helpful in providing an appreciation of the environment of the present invention. Considering FIG. 1 in further detail, there is illustrated therein a developing station 4 comprised of a developer apparatus 20 which includes a toner powder dispenser means 10, a developer sump or reservoir 100, magnetic transport means 112, a chute 110 and a sensing means 11. Toner powder dispensing means 10 may take the form of any conventional device which accurately meters a powder or a finely granulated material. Dispensing means 10 may, for example, comprise the dispenser device described in U.S. Pat. No. 3,031,703 which issued to R.A. Hunt on Dec. 19, 1961.

Reservoir 100, which may take the form of a receptacle capable of retaining a developer material such as a twocomponent magnetic developer mixture as previously mentioned, may be comprised of interior wall 101, bottom wall 102, a front wall (not shown) and a rear wall 106. Reservoir 100 is preferably disposed adjacent to plate 1 and is located such that toner powder metered from dispensing means 10 is permitted to freely fall therein.

Magnetic transport means 112 may take the form of a plurality of rollers 103, 104 and 105 and corresponding fixed stationary magnet means 107, 108 and 109. Each of rollers 103, 104 and 105 is suitably mounted for rotation within the housing of developer apparatus 20 and each roller may be comprised of an outer rotatable metallic sleeve-like member. Magnet means 107, 108 and 109 may be comprised of permanent magnets disposed within corresponding rollers 103, 104, and 105 and are configured to subtend a predetermined angle within the rollers. Preferably, roller 103 is disposed so as to extend into the developer mixture retained in reservoir 100.

Chute 110, which may be comprised of any suitable material, such as a smooth plastic, and which may take the form of a conventional funnel or conduit, is disposed with the ingress thereof substantially adjacent and in a particle receiving relationship with respect to roller 105. In addition, chute 110 is configured to extend over a portion of the length of roller 105 in order to collect a random portion of the particles released by this roller. Sensing means 11, which will be described subsequently in detail, is disposed at the egress of chute 110, or alternatively, sensing means 11 may be conveniently located below and spaced away from the egress of chute 110.

The operation of the apparatus illustrated in FIG. 1 will now be described. In order to apply toner powder to photoreceptor plate 1, rollers 103, 104 and 105 and plate 1 are rotated in the directions indicated by corresponding arrows illustrated in FIG. 1. As roller 103 rotates past the lower end of stationary magnet 107, magnetic carrier particles of the aforedescribed developer mixture are attracted to and adhere to the exterior surface of roller 103. In this manner, toner particles are applied to the photoreceptor plate 1 at the nip formed by roller 103 and the plate 1 as the latent electrostatic image on photoreceptor plate 1 is effective to pull toner powder away from the carrier particles. The denuded carrier particles, as well as those carrier particles which have not yielded toner powder carried thereon to photoreceptor plate 1, remain adhered or magnetically "tacked" to the exterior surface of roller 103 until the roller traverses the trailing edge (which is illustrated in FIG. 1 as the upper end) of stationary magnet 107. At this point carrier particles are released from the roller 103 and are transferred under the influence of stationary magnet 108 to the exterior surface of roller 104 at the nip formed between rollers 103 and 104 and are subsequently transferred in a similar manner to roller 105. Carrier particles attracted to the surface of roller 105 are released therefrom upon passing the trailing edge of magnet 109 and fall under the influence of gravity to either reservoir 100, or into chute 110 to sensing means 11 which senses the developability of developer material returned by the magnetic transport means subsequent to the developing operation.

It will be readily seen that the sample portion of developer material and denuded carrier particles collected in chute 110 and applied to sensing means 11 with respect to the total number particles released from roller 105 will depend upon the configuration of chute 110 and, therefore, the extent to which chute 110 parallels the axial dimension of roller 105.

Figure 1A:
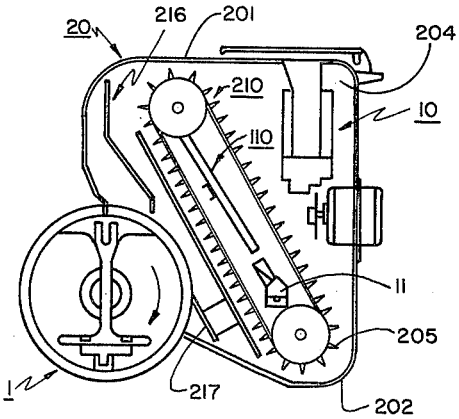
FIG. 1A is an elevational view of an exemplary embodiment of a bucket conveyor device which may be used, instead of the provision shown in FIG. 1, for applying a developer mixture to the photoreceptor surface of the machine.

As an alternative to the aforedescribed magnetic transport means 112 for applying toner powder to photoreceptor plate 1, the arrangement illustrated in FIG. 1A may be utilized. In this arrangement, developer apparatus 20 may comprise a driven bucket-type conveyor 210, housing walls 202 and 204, chutes 110 and 216, baffle 217, plate 1, dispenser means 10 and sensing means 11. Specifically, the developer apparatus 20 may be formed in a box-like housing having a top wall 201, an angular bottom wall 202, a front wall (not shown) and rear wall 204, and forming in the lower portion thereof a reservoir for developer material. The front wall and rear wall 204 (as shown in FIG. 1A) are formed with a concave edge portion in conformity with the shape of the photoreceptor plate 1 to permit the developer housing to be positioned closely adjacent thereto. Secured to the inside faces of the developer housing are suitable baffle plates, not shown, which prevent excessive dust and air currents from circulating within the developer housing adjacent to the photoreceptor plate 1.

The bucket-type conveyor 210 comprises a series of spaced buckets 205 secured to a conveyor belt arrangement entrained about a drive pulley and an idler pulley mounted on appropriate drive and idler shafts, respectively. Buckets 205 may take any suitable form which permits developer material to be released therefrom as each bucket 205 passes the upper pulley.

Operation of the exemplary embodiment of the developer material transport apparatus illustrated in FIG. 1A will now be described. Upon application of a motive drive to photoreceptor plate 1 and bucket conveyor 210, buckets 205 are driven in conventional manner and are effective to collect developer material in the lowermost portion of the housing of developer apparatus 20 and release the same upon traversing the upper pulley of conveyor 210. Developer material is thus cascaded over hopper chute 216 onto plate 1 with a portion of the cascaded developer material falling or being thrown therefrom with the remaining portion of developer material being attracted to plate 1 to form toner powder images thereon. A portion of the developer material passing off plate 1, along with other undeposited toner particles, is received by baffle 217 for return to the reservoir containing developer material with a portion of the developer material released by buckets 205 collected by chute 110 and returned to sensing means 11 for an analysis of the developability thereof as will be subsequently described.

Figure 2:
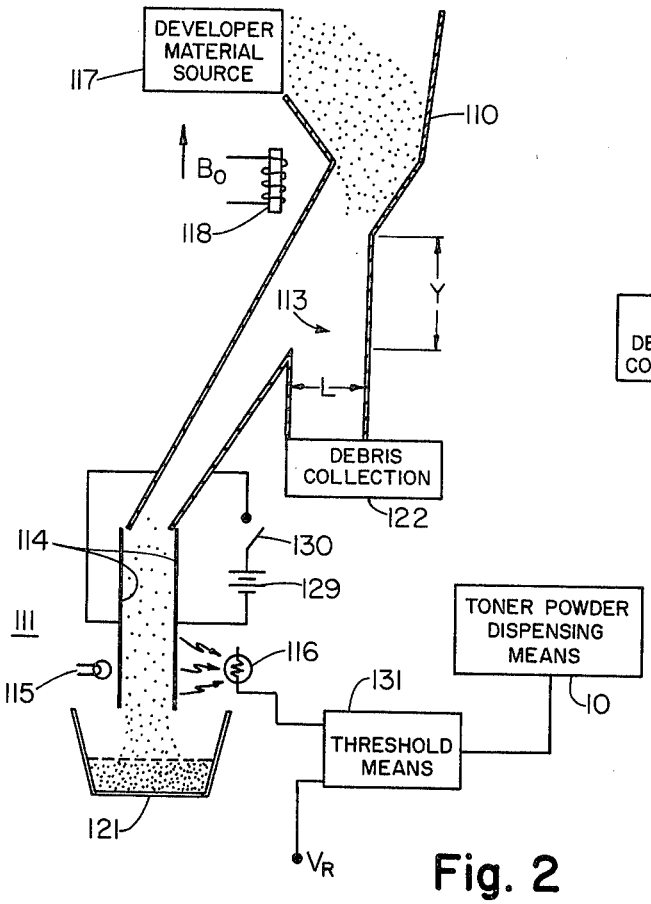
FIG. 2 is a diagrammatic illustration, partially in section and partially in block diagram form, of an exemplary embodiment of the present invention utilized with an automatic developability control system.

Referring now to FIG. 2, there is illustrated therein an exemplary embodiment of an anti-plugging apparatus for an automatic developability control system comprising developer material source 117, chute 110, magnet means 118, debris collection means 122, automatic developability control means 111, threshold means 131 and toner powder dispensing means 10.

Developer material source 117 may comprise any source of unused or returned developer material. For example, such developer material may comprise the unused developer material displaced from reservoir 100 and received by chute 110 or the developer material being returned to a reservoir subsequent to the application of developer material to a photoreceptor plate 1. Accordingly, developer material source 117 may take the form of magnetic roller transport such as rollers 103–105 illustrated in FIG. 1 or a bucket conveyor-type transport for developer material such as bucket conveyor 210 illustrated in FIG. 1A. In addition, developer material source 117 may be comprised of a magnetic brush applicator in combination with a developer material such as a two-component development mixture as previously described.

Chute 110, which is preferably inclined, is preferably comprised of a suitable non-magnetic metallic material such as aluminum, and is provided with an ingress at the upper end thereof and an egress at the lower extremity. An aperture 113 is defined in chute 110 and disposed intermediate the upper and lower ends thereof. The ingress of chute 110 is adapted to receive developer material, which is preferably comprised of a two-component developer mixture, supplied by source 117. Aperture 113 may be formed at any convenient location along the length of chute 110 and provides an exit path for debris material and communication between debris collection means 122 and chute 110. Additionally, the egress of chute 110 is disposed substantially adjacent to and in communication with the ingress of automatic developability control means 111.

Magnet means 118 may take the form of an energizable electromagnet comprised of a conventional electrical coil and a core of magnetisable material. Alternatively, magnet means 118 may comprise a permanent magent capable of providing a magnetic field of sufficient strength to deflect magnetic carrier particles falling through chute 110 as will be described hereinafter. Although magnet means 118 is illustrated in FIG. 2 as spaced away from chute 110 other configurations of magnet means 118, as will be described subsequently, may be utilized. Preferably, the magnetic field produced by magnet means 118 is applied through a portion of chute 110 between the ingress thereof and aperture 113.

It will be appreciated that in order to assure that carrier particles supplied by developer material source 117 are transmitted through chute 110 to automatic developability control means 111, such particles must be deflected by magnet means 118 to an extent sufficient to bridge aperture 113. Therefore, several parameters which, for example, include the mass of a typical or average carrier particle, the magnitude or the intensity ($B_o$) of the magnetic field produced by magnet means 118, the degree of inclination of chute 110, the horizontal length L of aperture 113 and the vertical length $y$ between upper and lower edges of aperture 113 must be considered. The degree of inclination of chute 110 will determine the velocity of any particular carrier particle at, for example, the upper edge of aperture 113. Thus, for a particular magnetic field intensity $B_o$, a predetermined inclination of chute 110, and horizontal length L of aperture 113, the required vertical distance $y$ may be calculated. It also is realized that although portions of chute 110 on opposite sides of aperture 113 are shown in FIG. 2 as lying in a common plane, such a relationship is exemplary and will not necessarily obtain for all permissible values of the foregoing parameters.

Assuming that the effects of air resistance on carrier particles are negligible, the resultant force operating on a carrier particle as the particle falls from the upper edge of aperture 113 can be expressed as:

$$\frac{m\,d^2y}{d\,t^2} = F_m - F_g \qquad (1)$$

where $m$ = the mass of a particle, $F_m$ = the magnetic force acting upwardly and $F_g$ = the gravitational force acting on the particle. By integrating equation (1) twice the expression for the height $y$ may be obtained:

$$y = \frac{(F_m - F_g)\,\frac{t^2}{2} + m\,v_{oy}\,(t) + D}{m} \qquad (2)$$

where $v_{oy}$ equals the vertical component of the velocity of a carrier particle at the upper edge of aperture 113 and $D$ equals an initial distance, (i.e. at the upper edge of aperature 113, D = 0). Assuming that the horizontal dimension of aperture 113 is $L$, $$t = \frac{L}{v_{ox}} \qquad (3)$$

where $v_{ox}$ equals the horizontal component of the velocity of a particle passing the upper edge of aperture 113. Thus, $$y = \frac{(F_m - F_g)\left(\frac{L}{v_{ox}}\right)^2 \cdot \tfrac{1}{2} + m\,\frac{v_{oy}}{v_{ox}}(L)}{m} \qquad (4)$$

The gravitational force acting on a particle may be expressed as:

$$F_g = mg \qquad (5)$$

The magnetic force acting on a particle may be expressed as:

$$\overline{F_m} = \int \overline{M} \circ \overline{\nabla}\,\overline{B_o}\,d\,T \qquad (6)$$

where $$\overline{M} = \frac{(\mu_i - 1)}{(\mu_i + 2)}\;\frac{3\,\overline{B_o}}{4\pi} \qquad (7)$$

In that expression $B_o$ equals the magnetic field intensity produced by magnet means 118, $\mu_i$ equals the permeability of a carrier particle and $dT$ = the volume element of the sphere comprising each carrier particle. Assuming the magnetic field is almost uniform, Equation (6) yields $$F = V\,(\overline{M} \circ \overline{V})\,\overline{B_o} \qquad (8)$$

where $V$ is the volume of a carrier bead. For a bead of radius '$a$', $V$ becomes $(4/3)\pi a^3$. Substituting the expression for $M$ from Equation (7) into Equation (8) and using the identity $$(\overline{B} \circ \nabla)\,\overline{B} = \tfrac{1}{2}\nabla B^2 - B X (\nabla X B)$$

and recalling $\nabla X B = 0$ yields $$\overline{F} = \frac{a^3}{2}\left(\frac{\mu_i - 1}{\mu_i + 2}\right)(\nabla) B_o^2 \quad (9)$$

Assuming the beads are at some distance from the source of the magnetic field and the field varies as $$\overline{B}_o = \frac{B_o \hat{J}}{X^n} \quad (10)$$

along the $y$ (vertical) direction where '$n$' is adjusted for the magnetic configuration and is a unit vector along the vertical axis. Using Equation (9) to calculate the vertical component of the force $F_m$ ($y$) yields $$F_m(y) = a^3 \frac{(\mu_i - 1)}{(\mu_i + 2)} B_o^2 \left[\frac{-n}{d^{2n+1}}\right] \quad (11)$$

where '$d$' is the distance between the bead and the magnet. Substituting Equation (10) in Equation (4) yields $$y = \left\{a^3 \frac{(M_i - 1) B_o^2}{(M_i + 2) M}\left[\frac{-n}{d^{2n+1}}\right] - g\right\} \frac{1}{2}\left(\frac{L}{v_{ox}}\right)^2 + \frac{v_{oy} L}{v_{ox}} \quad (12)$$

It will be appreciated, therefore, that equation (12) provides a definition of the vertical height $y$ of aperture 113 in terms of the initial velocity of a carrier particle, and hence, the degree of inclination of chute 110 and the horizontal length L of aperture 113. Alternately, for a predetermined inclination of chute 110 and a particular value of the vertical distance $y$, such as for example wherein portions of chute 110 on opposite sides of aperture 113 lie in a common plane, the largest permissible value of the dimension $L$ of aperture 113 for which magnetic carrier particles will bridge aperture 113 in the presence of a magnetic field intensity $B_o$ may be calculated by solving equation (11) for the term $L$.

Debris collection means 122 may take the form of a known receptacle suitable for receiving and retaining debris material such as bits of paper, rubber, dust or the like normally present within the electrostatic reproduction apparatus illustrated in FIG. 1. Preferably, such a receptacle is readily removable from developer apparatus 20 in order to facilitate the disposal of collected debris.

Automatic developability control system 111, which preferably includes sensing means 11 generally illustrated in FIGS. 1 and 1A and described in detail in U.S. Pat. No. 3,526,338, may conveniently take the form of an optical, particle density detection system comprised of transparent plates 114, radiation source 115, radiation responsive means 116, receptacle 121, potential source 129, and switch means 130, as illustrated in FIG. 2. Transparent plates 114 are preferably comprised of a conductive material such as NESA glass, as aforesaid, although it is realized that conventional nonconductive glass may be utilized if desired. Potential source 129 preferably takes the form of a conventional D.C. source and is effective to establish an electrostatic field across transparent plates 114. It is realized that the strength of the aforementioned field will depend on the spacing between transparent plates 114 and that such a spacing must be sufficiently great to enable a predetermined flow rate of developer materials to pass between transparent plates 114 substantially unimpeded. It has been found, for example, that such a spacing may be on the order of 0.060 inches and that potential source 129 may supply a potential of approximately 300 v. across transparent plates 114.

Switch means 130, which may take the form of a conventional solid-state switching element, is connected between potential source 129 and transparent plates 114. Preferably, switch means 130 comprises a solid state reversing switch to enable the polarity of the potential applied across transparent plates 114 to be reversed in order to clean plates 114 as previously mentioned.

Radiation source 115 may comprise a known device which, when electrically energized, emits radiation having a wavelength preferably within the visible spectrum. Thus, source 115 may be a conventional illumination source or comprise a source of infra-red radiation and is so disposed that produced radiation is guided or directed toward transparent plates 114. Radiation responsive means 116 may take the form of any suitable transducing device which produces an electric current having a magnitude which varies in accordance with the intensity of detected radiation. Accordingly, radiation responsive means 116 may comprise a known photocell element responsive to light produced by conventional sources or a known photovoltaic cell responsive to infra-red radiation.

It is realized that the radiation detected by radiation responsive means 116 may be the radiation emanating from source 115 which is passed directly through transparent plates 114 or the detected radiation may represent the radiation emanating from source 115 that is reflected or scattered by particles adhered to, or present between, transparent plates 114. Although either of the foregoing optical detection techniques may be utilized with automatic developability control system 111, the former technique is preferred. Accordingly, the magnitude of the signal generated by radiation responsive means increases with decreasing optical densities or with fewer particles of toner powder present in developer materials present between transparent plates 114. Thus, the magnitude of the signal produced by radiation responsive means 116 varies inversely with the developability of the developer material.

Receptacle 121 may take the form of any receptacle suitable for receiving and retaining particles of developer material, and for example may be comprised of reservoir 100 depicted in FIG. 1 or may be a separate receptacle suitably disposed within the housing of developer apparatus 20. Although it is preferred to dispose receptacle 121 immediately below the lower extremities of transparent plates 114, it is realized that receptacle 121 may be positioned at any convenient location within the housing of developer apparatus 20 and that a suitable chute or guide means (not shown) may be provided to direct developer material from the lower extremities of transparent plates 114 to receptacle 121.

Threshold means 131 may take the form of a conventional threshold device which acts in known manner to produce a predetermined output potential whenever the magnitude of a signal applied to a first input terminal exceeds the magnitude of an input signal applied to a second input terminal. The first input terminal of threshold means 131 may, for example, be coupled to the output of radiation responsive means 116 and a second input terminal of the threshold means may be coupled to a reference potential source $V_R$. The output of threshold means 131 is coupled to dispensing means 10 which has been previously described in conjunction with FIG. 1. Thus, threshold means 131 will produce a predetermined output potential whenever the magnitude of the signal generated by radiation responsive means 116 exceeds the magnitude of the reference voltage $V_R$ and this predetermined output potential will be absent whenever the output of radiation responsive means 116 fails to exceed the magnitude of reference voltage $V_R$.

The operation of the apparatus illustrated in FIG. 2 will now be described. It should be noted that the term "magnetic carrier particles" as used hereinabove and as provided hereafter may refer to conventional steel or ferrite beads normally used as the carrier component of two-component developers or any other form of carrier material capable of having its trajectory influenced by an externally supplied magnetic field. The term "nonmagnetic carrier particle" as used below refers to the conventional glass bead that finds ready application as a carrier component of two-component developers. As magnetic carrier particles supplied by source 117 are received in chute 110, previously energized magnet means 118 is effective to deflect these particles such that substantially all of the supplied carrier particles flow toward the egress of chute 110 and enter the space defined by plates 114 of the automatic developability control system 111. However, as particles of debris material most likely to become intermingled with the developer mixture primarily consist of paper, fibers, rubber, etc. as aforesaid, and therefore, are substantially nonmagnetic, such debris material will not be attracted toward the egress of chute 110 and will fall under the influence of gravity through aperture 113 to debris collection means 122. Accordingly, the carrier particles directed to automatic developability control system 111 for analysis of toner powder developability will be substantially free of debris material and a concommitant reduction in the likelihood of plugging or jamming of the passage between plates 114 is thereby effected. In addition, toner powder developability may be determined by sensing the optical density of toner powder falling between transparent plates 114. In a preferred mode of operation, radiation emitted from source 115 is transmitted through toner powder falling between transparent plates 114 with the amount of transmitted radiation detected by radiation responsive means 116. A signal representative of the intensity of transmitted radiation, and hence representative of the optical density and thus, developability, of the toner powder supplied to the automatic developability control system 111, is supplied to the first input terminal of threshold means 131. Whenever this input signal exceeds the magnitude of reference potential $V_R$, threshold means 131 produces a predetermined output potential effective to initiate operation of toner powder dispensing means 10 and thereby replenish toner powder in developer apparatus 20. However, whenever the magnitude of the output signal produced by radiation responsive means 116 fails to exceed the value of reference potential $V_R$, the predetermined output potential of threshold means 131 is absent and toner powder dispensing means 10 is de-activated to inhibit the replenishment of toner powder in developer apparatus 20. The developer material collected in receptacle 121 may be transferred to the reservoir or sump of the developer apparatus 20 illustrated in FIGS. 1 and 1A or the automatic developability control system 111 may be so positioned that all particles introduced into the passage between plates 114 merely fall by gravity into the aforedescribed receptacle 121 for subsequent removal by an operator.

It will be appreciated that suitable logic or switching means (not shown) may be coupled between the output of threshold means 131 and the input of toner powder dispenser means 10 to appropriately control dispenser means 10 in accordance with the presence or absence of the predetermined output potential of threshold means 131.

As previously mentioned, transparent plates 114 may be cleaned by the rapid actuation of reversing switch 130. The result of repeatedly changing the polarity of the potential supplied by source 129 is to cause particles of toner powder which may adhere to plates 114 to be separated or repelled by the electrostatic field thereby established and hence transparent plates 114 are effectively cleaned and a continuous sensing of falling developer material is thus achieved. It should be noted, however, that the foregoing cleaning operation requires that transparent plates 114 be comprised of conductive materials and in the event that non-conductive plates 114 are utilized, less efficient mechanical cleaning procedures must be undertaken to periodically clean plates 114.

It is realized that although a particular configuration of chute 110 is illustrated in FIG. 2, other chute arrangements may be employed. For example, chute 110 may be disposed such that a substantially vertical path is provided between the ingress and the egress thereof with a debris collection means 122 located at the egress of chute 110. In such a configuration, (not shown) aperture 113 is provided in the side of chute 110 and magnet means 118 is provided to deflect magnetic carrier particles falling downwardly in a substantially vertical direction through aperture 113 and an angulated exit conduit to automatic developability control system 111. In this alternate configuration, aperture 113 must be sufficiently large in area such that rapidly falling carrier particles may be deflected therethrough by magnet means 118.

Figure 3:
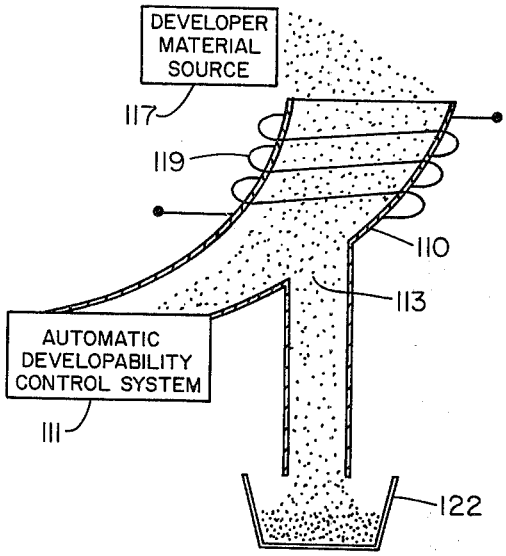
FIG. 3 is a diagrammatic illustration, partially in section and partially in block diagram form, of a further exemplary embodiment of the present invention.

Referring now to FIG. 3, there is illustrated a further exemplary embodiment of the present invention utilized in conjunction with an automatic developability control system of an electrostatic reproduction machine. The depicted anti-plugging device comprises a chute 110, automatic developability control system 111, developer material source 117, magnet means 119 and debris collection means 122. As all of the aforementioned structure, with the exception of magnet means 119, has been previously described, further description of the exemplary embodiment of the present invention depicted in FIG. 3 will be primarily directed to a description of magnet means 119 which may take the form of a conventional electrical coil wound around a portion of chute 110. Preferably, magnet means 119 is wound around a portion of chute 110 intermediate the ingress thereof and aperture 113. In operation, upon application of an electrical potential to magnet means 119, an electromagnetic field is established through chute 110 which is effective to deflect carrier particles toward the egress of chute 110 and hence, to automatic developability control system 111. However, as the debris material intermingled with the developer mixture supplied by source 117 is generally comprised of scraps of paper, bits of rubber, dust, etc. and therefore is substantially non-magnetic, debris material is unaffected by the electromagnetic field established in chute 113 and, accordingly, debris material exits from chute 110 by falling through aperture 113 to debris collection means 122. In this manner, debris material is separated from the developer mixture supplied from source 117 prior to the introduction of developer mixture into automatic developability control system 111.

Figure 4:
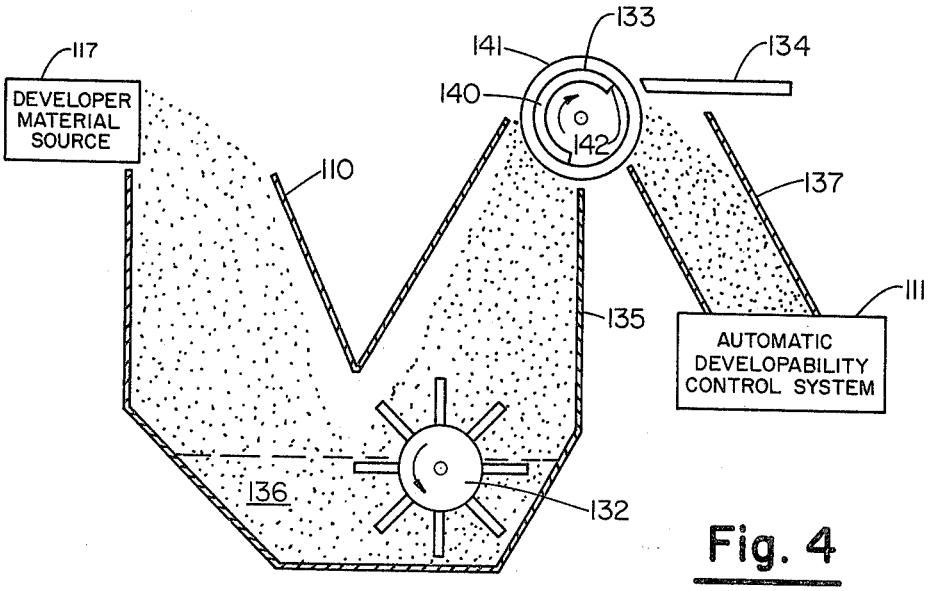
FIG. 4 is a diagrammatic illustration, partially in section and partially in block diagram form, of yet another exemplary embodiment of the present invention.

Referring now to FIG. 4, there is illustrated a further exemplary embodiment of the present invention wherein apparatus for separating developer material from debris material intermingled therewith comprises developer material source 117, chutes 110, 135 and 137, particle projecting means 132, magnetic transport means 141, baffle means 134 and automatic developability control system 111. Developer material source 117 may take the form of a developer material transport device, such as for example, the transports illustrated in FIGS. 1 and 1A, and when utilized in conjunction with the exemplary embodiment of the invention depicted in FIG. 4, is preferably adapted to supply a two-component developer mixture.

Chutes 110, 135 and 137 may comprise any conventional chutes or conduits having ingress and egress at opposed ends thereof. It is realized, however, that chute 110 is not provided with an aperture along the length thereof but functions as a simple conduit or funnel disposed to receive particulate developer material at the ingress thereof and to deliver such material to the egress at the lower extremity under the influence of gravity. In addition, chute 110 may be comprised of any suitable material, such as for example, a smooth plastic. Chutes 135 and 137 may be structured similar to chute 110 and the cooperation of all chutes with apparatus illustrated in FIG. 4 will be described hereinafter.

Receptacle 136 may take the form of any suitable receptacle for receiving and retaining particulate material and is disposed to communicate with chutes 110 and 135. It is realized that receptacle 136 may comprise a reservoir of returned or unused developer material such as reservoir 100 illustrated in FIG. 1. In addition, a toner powder dispensing means (not shown) may be suitably adapted to replenish the supply of toner powder present in receptacle 136 upon the production of an appropriate control signal by automatic developability control system 111.

Figure 5:
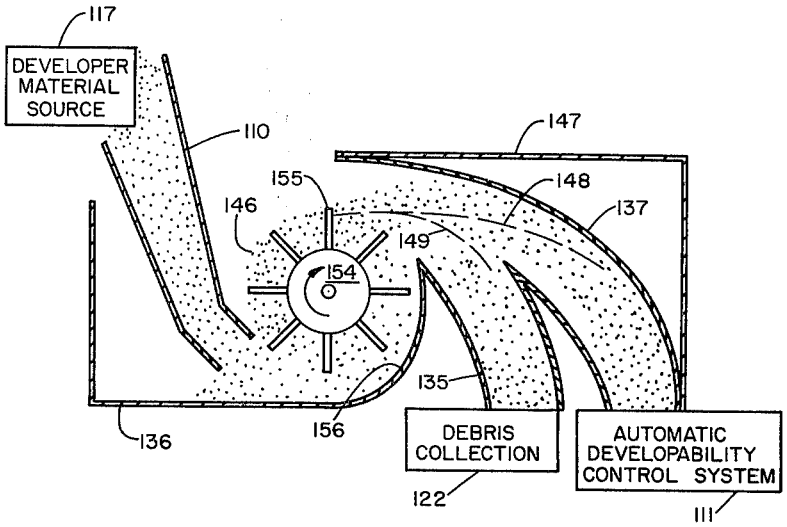
FIGS. 5 and 6 are also diagrammatic illustrations of yet further exemplary embodiments of the present invention.

Particle projecting means 132, which may take the form of a rotatable paddle wheel as illustrated in FIG. 5 or, for example, a rapidly reciprocable member, is provided within receptacle 136 for the purpose of projecting both particles of debris and developer mixture, preferably in an upward direction through chute 135. It is realized that upon utilization of a paddle wheel as a particle projecting means and rotation thereof in the direction of the arrow as illustrated, the aforementioned particles are projected or thrown upwardly through chute 135.

Magnetic transport means 141 may be comprised of an outer rotatable sleeve-like roller 133 and an inner fixed magnet 140 which subtends a predetermined angle of roller 133 and may be constructed in a manner similar to magnetic transport means 103, 104 or 105 illustrated in FIG. 1 and previously described. Magnetic transport means 141 is disposed in any convenient manner adjacent the egress of chute 135 such that magnetic carrier particles of the developer mixture directed upwardly through chute 135 contact and adhere to the portion of the surface of roller 133 coextensive with magnet 140. Baffle means 134, which may take the form of any conventional partition or screening element, is positioned to assist in the isolation of the developability system from dust particles and the like which may reside in the electrostatic system and additionally may be employed, if desired, to restrict the flow of developer material. It is realized that baffle means 134 may be adjustably positioned with respect the surface of roller 133, and is preferably located proximate edge 142 of magnet 140.

Chute 137 is suitably disposed to define a path of travel for carrier particles from magnetic means 141 to automatic developability control system 111. Accordingly, the ingress of chute 137 is positioned adjacent to roller 133 and baffle means 134 and the egress of chute 137 is coupled to the inlet of automatic developability control system 111. It is realized that baffle element 134 may be dispensed with should it prove that externally introduced dust and the like is not a problem and the flow of particles released from roller 133 need not be restricted. In addition, particle projecting means 132 may be configured to direct only a predetermined portion of the developer mixture present in receptacle 136 through chute 135 in the event that such a limited portion of developer material represents an adequate supply of such material for successful operation of automatic developability control system 111.

The operation of the exemplary embodiment of the present invention illustrated in FIG. 4 will now be described. Particles of developer mixture supplied by developer material source 117 which are intermingled with debris material are received by chute 110 and fall under the influence of gravity through chute 110 to receptacle 136. Particle projecting means 132 is rotatably driven in a counterclockwise direction as illustrated and is thereby effective to throw particles present in receptacle 136 upwardly through chute 135 into contact with roller 133. The carrier particles are magnetically entrained on to the outer rotating sleeve comprising roller 133 and are carried thereon, under the influence of magnet 140, toward the baffle element 134 which is disposed substantially in juxtaposition with edge 142 of magnet 140. Debris material which is generally comprised of non-magnetic materials as aforesaid, will not adhere to roller 133 upon contact therewith and will fall back through chute 135 to receptacle 136 under the influence of gravity. Accordingly, the carrier particles released or separated from magnetic roller 133 are received by chute 137 for introduction into automatic developability control system 111 with such particles being substantially free of machine debris.

In the exemplary embodiments of the present invention, illustrated in FIGS. 1 to 4, electrostatic reproduction apparatus utilizing a two-component developer material has been described. Specifically, the developer material is comprised of a magnetic carrier particle and particles of finely granulated toner powder. In the previously described exemplary embodiments of the present invention, the magnetic properties of carrier particles have been relied upon to enable such carrier particles to be separated from debris materials intermingled therewith prior to introduction of such carrier particles into an automatic developability control system. However, those skilled in the electrostatic or electrographic reproduction arts will appreciate that two-component developer mixtures comprised of a non-magnetic carrier particles and toner powder may be utilized in order to form toner powder images upon a photoreceptive plate. Accordingly, the nonmagnetic carrier particles of such developer mixtures may take the form of small glass or sand beads. As a result of triboelectrification, particles of toner powder are suitably charged and the glass beads thus form acceptable carrier particles for the toner powder. However, in order to separate such carrier particles from debris material intermingled therewith, separation techniques cannot, of course, rely upon magnetic properties as described heretofore.

Referring now to FIG. 5, there is shown an exemplary embodiment of apparatus for separating developer material exhibiting either magnetic or non-magnetic characteristics from debris materials in accordance with the teachings of the present invention; however, as magnetic embodiments of the instant invention have previously been employed, it will here be assumed that non-magnetic carrier materials are being utilized. The illustrated apparatus comprises a developer material source 117, chutes 110, 135 and 137, receptacle 136, a particle projection means 146, debris collection means 122 and an automatic developability control system 111. Inasmuch as developer material source 117, debris collection means 122, and control system 111 have been previously described in detail and as the foregoing devices illustrated in FIG. 5 operate in an identical manner to the previously described devices of like reference numerals, further description thereof is considered unnecessary. Particle projection means 146 may take the form of a conventional paddle wheel 154 having paddle arms 155 projecting therefrom and is adapted to be rotated about a central axis. Alternatively, a reciprocable element suitably adapted for reciprocatory motion within receptacle 136 may be utilized as well. Particle projecting means 146 is suitably mounted for rotation within receptacle 136 and preferably, is so mounted such that paddle arms 155 projecting therefrom extend into a supply of developer material and debris intermingled therewith retained in receptacle 136. Upon rotation of paddle wheel 154 particulate material is carried by each paddle arm 155 to a position substantially atop paddle wheel 154 from which position particles are thrown or projected by each paddle arm 155 as will be described in greater detail hereinafter.

Chute 135, which may take the form of a known conduit or funnel, may be located substantially adjacent to receptacle 136. Furthermore, the ingress of chute 135 is preferably located immediately adjacent to wall portion 156 of receptacle 136 and the egress of chute 135 is disposed in communication with debris collection means 122. Chute 137, which like chute 135 may comprise a known funnel or conduit, is preferably located adjacent to chute 135 and is thereby spaced away from particle projection means 146 as depicted in FIG. 5. The ingress of chute 137 may be located substantially in the same horizontal plane as the ingress of chute 135 and the egress of chute 137 is preferably disposed in communication with automatic developability control system 111. Accordingly, it is realized that particles projected from particle projection means 146 along the trajectory 148 are received at the ingress of chute 137 and particles projected along the trajectory indicated by broken line 149, are received at the ingress of chute 135. A cover 147, which may comprise a portion of the housing of the developer apparatus, may be formed to extend substantially over particle projection means 146 as depicted in FIG. 8. Alternatively, cover 147 may comprise a portion of receptacle 136 or such a cover may comprise a known baffle means for assisting in the retention of particulate material within receptacle 136. In addition, a portion of chute 137 may also extend upwardly and may be joined with cover 137 to insure that particles projected along trajectory 148 are in fact received at the ingress of chute 137.

The operation of the exemplary embodiment of the present invention shown in FIG. 5 will now be described. Developer material source 117 is effective to supply, as previously described, a two-component non-magnetic developer mixture to the ingress of chute 110. Debris material intermingled with the aforementioned developer mixture falls under the influence of gravity through chute 110 to receptacle 136. Particle projection means 146 is adapted to be rotated within receptacle 136 and particles are projected from each paddle arm 155 in the following manner upon clockwise rotation of paddle wheel 154. It is recalled that carrier particles may take the form of small steel or glass beads and, as such beads are of substantially greater density than debris material such as scraps of paper or rubber, carrier particles will be projected from paddle arm 155 substantially along the trajectory indicated by broken line 148 and will be received at the ingress of chute 137 for subsequent transmission to automatic developability control system 111. However, as debris material is less dense than the average carrier particle as aforesaid, debris material projected from each paddle arm 155 will be projected substantially along the trajectory indicated by broken line 149 and will be received at the ingress of chute 135 for subsequent transmission to debris collection means 122. Thus, machine debris is effectively separated from carrier particles and the undesirable plugging or jamming of automatic developability control system 111 is substantially prevented.

It is realized that although chutes 135 and 137 are illustrated as being formed in a curvilinear configuration, the conduit or funnel forming chute 135 or chute 137 may be provided with substantially planar surfaces. In addition, it is realized that the cross-sectional dimensions of the ingress of chutes 135 or 137 may be determined empirically in relation to the preferred speed of rotation of paddle wheel 154 and the average or representative densities of both debris material and carrier particles.

Figure 6:
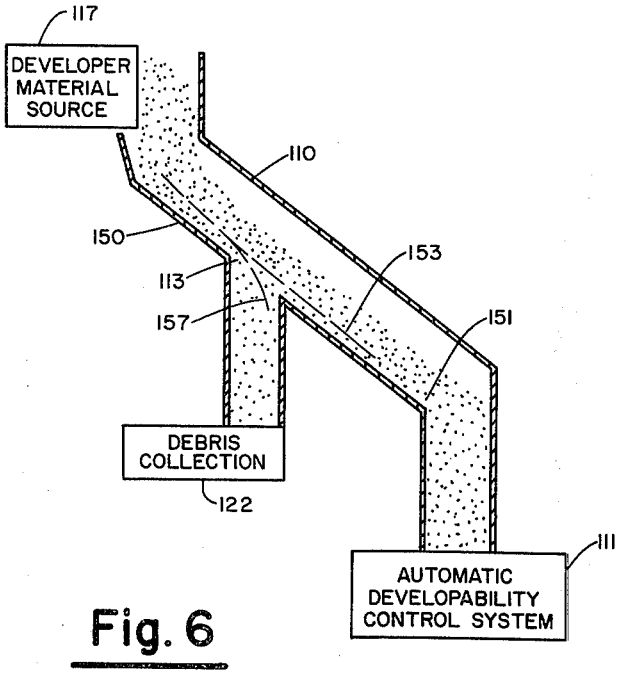

A further exemplary embodiment of the present invention wherein debris material is separated from a two-component developer mixture comprised of non-magnetic carrier particles and toner powder adhered thereto is illustrated in FIG. 6. The anti-plugging apparatus depicted is comprised of a chute 110, developer material source 117, debris collection means 122, and an automatic developability control system 111. Developer material source 117, collected means 122 and control system 111 have been previously described and, accordingly, further description thereof is considered unnecessary in obtaining an understanding of the novel aspects of the exemplary embodiment of the present invention shown in FIG. 6. Chute 110 is disposed in an inclined relationship with the ingress thereof adapted to receive developer material supplied by source 117. An aperture 113 is defined in chute 110 with portions 150 and 151 of chute 110 being disposed above and below aperture 113, respectively. Portions 150 and 151 may be configured to lie in the same plane or, as depicted in FIG. 6, such portions may lie in different planes. Chute 110 may be formed from a known material such as a smooth plastic and may be configured so as to exhibit any convenient cross-section such as a substantially rectangular cross-section. In addition, aperture 113 defined in chute 110, may be formed in any convenient shape, such as a rectangular configuration with the greater dimension thereof extending substantially completely across the bottom, or lower surface, of chute 110. It is realized, however, that both chute 110 and aperture 113 defined therein may be configured in other geometric cross sections, such as for example, in circular shapes.

The operation of the exemplary embodiment of the present invention illustrated in FIG. 6 will now be described. Developer material source 117 is effective to supply a developer mixture which is preferably comprised of non-magnetic carrier particles and toner powder adhered thereto to the ingress of chute 110. The developer mixture and debris material intermingled therewith slide along inclined portion 150 of chute 110 under the influence of gravity. Upon reaching the lower end of portion 150 of chute 110, the velocity of carrier particles will impart a sufficient kinetic energy to each particle such that carrier particles will substantially follow a trajectory indicated by broken line 153 and, accordingly, bridge aperture 113 and slide along lower portion 151 of chute 110. However, as particles of debris material which are substantially less dense than carrier particles as aforementioned, traverse the lower end of portion 150, debris material falls through aperture 113 and is received by debris collection means 122. In addition, as particles of debris material such as bits of paper, rubber, etc., commonly offer a greater surface area to ambient air, such material encounters a significantly greater air resistance than is encountered, for example, by carrier particles comprised of concentrated glass beads. Accordingly, the ability of debris material initially intermingled with carrier particles to bridge aperture 113 is substantially impeded. Thus, debris material falls under the influence of gravity along a trajectory indicated by broken line 157 and is subsequently received by debris collection means 122. Carrier particles which subsequently slide along portion 151 and are introduced into automatic developability control system 111 are, therefore, substantially free of debris material and, consequently, plugging or jamming of system 111 is effectively prevented. It is realized that as the size and weight of particles of debris material may vary considerably at any particular time, the particular inclination selected for chute 110 and the particular dimensions of aperture 113 will best be empirically derived from operational experience. However, the exemplary embodiment of the present invention shown in FIG. 6 provides a simple anti-plugging device which avoids the requirement of providing moving parts and, consequently, the necessary driving means therefor.

Although the embodiments depicted in FIGS. 5 and 6 have been described with respect to two-component developers comprised of non-magnetic carrier particles, it should be fully appreciated that the operation thereof is not affected by the application of magnetic carrier particles thereto. Hence, the apparatus shown in FIGS. 5 and 6 may be facilely employed with magnetic developer mixtures.

While the instant invention has been particularly shown and described with reference to exemplary embodiments thereof, it will be obvious to those skilled in the art that various changes and modifications in form and details may be made without departing from the spirit and scope of the invention. It is, therefore, intended that the appended claims be interpreted as including all such changes and modifications.

What is claimed is:

1. Apparatus for separating debris material from a magnetic developer material comprising:

means for supplying said magnetic developer material;

chute means for receiving said magnetic developer material and debris material intermingled therewith at the ingress thereof, said chute means being inclined from vertical and having an aperture defined therein through which debris material falls, said aperture formed in the lower surface of said chute means intermediate the ingress and egress thereof;

automatic developability control means for monitoring the developability of said magnetic developer material, said automatic developability control means disposed in a receiving relationship with respect to the egress of said chute means; and means for providing a magnetic force to prevent said magnetic developer material from falling through said aperture in said chute means.

2. Apparatus for separating debris material from a magnetic developer material comprising:

means for supplying said magnetic developer material;

chute means for receiving said magnetic developer material at the ingress thereof, said chute means having an aperture defined therein for providing an exit from said chute means for said debris material;

automatic developability control means for monitoring the developability of said magnetic developer material, said control means being disposed in a receiving relationship with respect to the egress of said chute means;

electromagnetic coil means wrapped around at least a portion of said chute means, whereby upon energization of said coil means a magnetic force is produced which substantially prevents said magnetic developer material from exiting from said chute means through the aperture defined therein.

3. Apparatus as defined in claim 2 wherein said chute means is inclined from vertical, and said electromagnetic coil means is wrapped around at least a portion of said chute means extending between said ingress and said aperture.

4. Apparatus for separating debris material from a magnetic developer material comprising:

means for supplying said magnetic developer material;

chute means for receiving said developer material and debris material intermingled therewith, said chute means comprised of a substantially vertically disposed main portion having an ingress and egress and an angulated exit portion communicating with said main portion through an aperture in said main portion;

automatic developability control means for monitoring the developability of said magnetic developer material, said control means being disposed in a receiving relationship with respect to said angulated exit portion of said chute means; and means for providing a magnetic force to deflect substantially only the magnetic developer material within the main portion of said chute means; whereby the developer material passes through said aperture into said angulated exit portion of said chute means unaccompanied by any appreciable debris material.

5. Apparatus as defined in claim 4 further comprising debris collection means disposed in a receiving relationship with respect to the egress of the main portion of said chute means.

6. For use in an electrographic printing machine wherein electrostatic latent images are developed into viewable images, the combination comprising:

means for supplying magnetic developer material;

chute means for receiving said magnetic developer material and debris material intermingled therewith at the ingress thereof, said chute means admitting of an inclined configuration and having a debris discharge aperture formed in a lower portion of the surface thereof intermediate the ingress and egress of said chute means;

automatic developability control means for monitoring the developability of said magnetic developer material, said automatic developability control means disposed in a receiving relationship with respect to the egress of said chute means; and means for providing a magnetic force to prevent said magnetic developer material from falling through said debris discharge aperture in said chute means.

7. In combination with an automatic developability control means for monitoring the developability of a magnetic developer material, a system for separating debris material from said developer material; said system comprising particle projection means for propelling intermingled developer material and debris material along a predetermined path, and magnetic transport means disposed in said path for magnetically entraining and transporting said developer material toward said automatic developability control means while inhibiting the passage of said debris material.

8. The combination of claim 7 wherein said magnetic transport means comprises magnetic roll means.

9. Apparatus as defined in claim 8 wherein said magnetic roll means comprises a rotatable and substantially cylindrical outer sleeve and a stationary magnet disposed interiorly of and subtending a predetermined angle of said sleeve such that magnetic developer material incident upon said sleeve adheres to a portion of the surface of said sleeve coextensive with the angle subtended by said stationary magnet.

10. The combination of claim 7 further including a sump for storing intermingled developer material and debris material; said particle projection means comprising a paddle wheel mounted for rotation within said sump for propelling said magnetic developer material and debris material into contact with said magnetic transport means.

11. Apparatus as defined in claim 10 further comprising retaining means for holding a supply of said intermingled developer and debris material and chute means extending upwardly from said retaining means and wherein said magnetic transport means is positioned adjacent the upper end of said chute means, such that upon rotation of said paddle wheel means, magnetic developer material and debris material are directed upwardly through said chute means into contact with said magnetic transport means.

* * * * *